US009950546B2

(12) United States Patent
Sakai et al.

(10) Patent No.: US 9,950,546 B2
(45) Date of Patent: Apr. 24, 2018

(54) RECORDING APPARATUS

(71) Applicant: SEIKO EPSON CORPORATION, Tokyo (JP)

(72) Inventors: Hiroaki Sakai, Chino (JP); Yuichi Honobe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/634,224

(22) Filed: Feb. 27, 2015

(65) Prior Publication Data

US 2015/0258818 A1 Sep. 17, 2015

(30) Foreign Application Priority Data

Mar. 12, 2014 (JP) ..... 2014-048528
Mar. 31, 2014 (JP) ..... 2014-071233

(51) Int. Cl.
*B41J 3/28* (2006.01)
*B41J 11/00* (2006.01)

(52) U.S. Cl.
CPC ..... *B41J 11/0085* (2013.01); *B41J 3/28* (2013.01); *B41J 11/0005* (2013.01); *B41J 11/0045* (2013.01)

(58) Field of Classification Search
CPC ... B41J 11/005; B41J 11/06; B41J 3/28; B41J 13/0027
See application file for complete search history.

(56) References Cited

U.S. PATENT DOCUMENTS

| | | | | |
|---|---|---|---|---|
| 6,088,081 | A | 7/2000 | Doi | |
| 8,356,881 | B2 | 1/2013 | Ohnishi | |
| 8,944,588 | B2 * | 2/2015 | Herrmann | B41J 11/0085 347/104 |
| 2010/0271453 | A1 * | 10/2010 | Toya | B41J 11/0085 347/104 |
| 2012/0019580 | A1 * | 1/2012 | Tokushima | B41J 11/006 347/14 |
| 2012/0236101 | A1 * | 9/2012 | Kato | B41J 11/06 347/104 |
| 2013/0256972 | A1 | 10/2013 | Herrmann | |
| 2015/0151411 | A1 * | 6/2015 | Veis | B41J 11/0085 347/104 |

FOREIGN PATENT DOCUMENTS

| | | |
|---|---|---|
| JP | 2003-211749 | 7/2003 |
| JP | 2003-246042 | 9/2003 |
| JP | 2005-335400 | 12/2005 |
| JP | 2005335246 | 12/2005 |
| JP | 2006-206194 | 8/2006 |
| JP | 2010-137483 | 6/2010 |
| JP | 2011-167926 | 9/2011 |
| JP | 2013-019083 | 1/2013 |
| JP | 2013132789 | 7/2013 |

* cited by examiner

*Primary Examiner* — Kristal Feggins
*Assistant Examiner* — Kendrick Liu
(74) *Attorney, Agent, or Firm* — Workman Nydegger

(57) ABSTRACT

A printer includes a recording head performing recording on a medium and includes a base stand that has a mounting surface capable of mounting the medium. A pump that absorbs or suctions the medium mounted on the mounting surface of the base stand, in which a pressure or a suction force is applied from a part of the medium to an entirety thereof.

12 Claims, 7 Drawing Sheets

RECORDING APPARATUS

CROSS-REFERENCE TO RELATED APPLICATIONS

The present application claims priority to Japanese Patent Application No. 2014-048528 filed on Mar. 12, 2014, and Japanese Patent Application No. 2014-071233, filed on Mar. 31, 2014, which applications are hereby incorporated by reference in their entirety.

BACKGROUND

1. Technical Field

Embodiments of the present invention relate to a recording apparatus that performs recording on a medium.

2. Related Art

In the related art, a recording apparatus in which recording is performed by forming an image on a medium is widely known (for example, see JP-A-2013-19083 and JP-A-2003-211749). In such a recording apparatus, rollers come into contact with a medium such as a material to be printed that is mounted on a mounting stand. The mounting stand and the rollers are relatively moved to remove wrinkles in the material. The material to be printed is pressed by the rollers and wrinkles occurring in the material are removed. Furthermore, in such a recording apparatus, in a state where a negative pressure is generated in a suction hole formed on or in an overlying surface of an absorption plate, the medium is transported to the overlying surface of the absorption plate.

Then, because the medium is absorbed or suctioned to the overlying surface of the absorption plate in order from an end portion of the medium on a downstream side of a transport direction by such a configuration, the occurrence of wrinkles in the medium absorbed on the overlying surface of the absorption plate is suppressed.

However, in the recording apparatus described above, when the rollers press the material to be printed, there is a problem that the wrinkles of the material to be printed cannot be appropriately removed by generating positional deviation of the material to be printed with respect to the mounting stand. Furthermore, in the recording apparatus described above, in a state where the negative pressure is generated in the suction hole of the absorption plate, if the medium is mounted from above the absorption plate, since an absorption force acts on an entire region of the medium at once from the overlying surface of the absorption plate, there is a problem that the wrinkles are likely to occur in the medium.

SUMMARY

An advantage of some aspects of the invention is to provide a recording apparatus in which wrinkles occurring in a medium can be appropriately removed. Embodiments of the invention further relate to a recording apparatus in which the occurrence of wrinkles in the medium mounted on a mounting section can be suppressed.

According to an aspect of the invention, a recording apparatus is provided that includes a recording section that performs recording on a medium. The recording apparatus includes a support section that supports the medium, an absorption or suction section that absorbs or suctions the medium to the support section, and a pressure applying section that applies a pressure to the medium while moving relative to the medium absorbed or suctioned to the support section.

In the recording apparatus, the absorption or suction section is capable of performing a first absorption or suction mode and a second absorption or suction mode having an absorption or suction force greater than that of the first absorption or suction mode in one example. If the pressure applying section applies the pressure to the medium, the first absorption or suction mode is performed.

In the recording apparatus, the absorption section performs the second absorption mode if the pressure applying section completes an applying operation of the pressure to the medium in one example.

In the recording apparatus, the absorption section performs the absorption in the first absorption mode to or with respect to a portion of the medium to which the pressure is not applied by the pressure applying section. The absorption section performs the absorption in the second absorption mode to or with respect to a portion of the medium to which the pressure is applied by the pressure applying section.

In one example, the recording apparatus further includes a sensor that detects a thickness of the medium and a distance adjusting section that adjusts a distance between the medium and the pressure applying section in a thickness direction of the medium based on a detection result of the sensor. The pressure applying section performs application of the pressure to the medium in a non-contact manner. When comparing operations of the distance adjusting section in each of two detection results in which the thicknesses of the medium detected by the sensor are different from each other, and in a case where the thickness of the medium detected by the sensor is relatively thick, the distance adjusting section sets the distance between the medium and the pressure applying section to be shorter than that in a case where the thickness of the medium is relatively thin.

In the recording apparatus, the pressure applying section starts application of the pressure from a portion of the medium in the medium in which recording is started by the recording section in one example.

According to another aspect of the invention, a recording apparatus is provided that includes a recording section that performs recording on a medium. The recording apparatus includes a mounting section that has a mounting surface capable of mounting the medium, and an absorption section that absorbs or sucks the medium mounted on the mounting surface of the mounting section. The absorption section performs absorption of the medium mounted on the mounting surface of the mounting section in order from an end portion thereof in a direction along the mounting surface.

In the recording apparatus, when directions orthogonal to each other in a direction along the mounting surface of the mounting section are a first direction and second direction, the end portion includes end portions of both the first direction and the second direction in the mounting surface of the mounting section in one example.

In the recording apparatus, recording section starts recording from a portion of the medium in the medium mounted on the end portion of the mounting section in one example.

In the recording apparatus, the mounting section includes a plurality of suction holes that are opened to the mounting surface and negative pressure chambers that communicate with the plurality of suction holes. The absorption section sucks the medium mounted on the mounting surface through the suction holes and absorbs or sucks the medium to the mounting surface by generating a negative pressure in the negative pressure chamber by sucking air inside the negative pressure chamber from the end portion of the mounting section.

In the recording apparatus, in the negative pressure chamber, a cross-sectional area of a flow path of air which is sucked by the absorption section gradually widens as a distance from the end portion of the mounting section is increased in one example.

In the recording apparatus, the plurality of suction holes are arranged radially from the end portion with respect to the mounting surface of the mounting section in one example.

In the recording apparatus, opening areas of the plurality of suction holes gradually narrow as the distance from the end portion of the mounting section is increased in one example.

In the recording apparatus, a hole density of the plurality of suction holes is gradually decreased as the distance from the end portion of the mounting section is increased in none example.

BRIEF DESCRIPTION OF THE DRAWINGS

Embodiments of the invention will be described with reference to the accompanying drawings, wherein like numbers reference like elements.

FIG. 2A is a schematic view illustrating a state before a pressing roller comes into contact with the medium, FIG. 2B is a schematic view illustrating a state where the pressing roller comes into contact with the medium, FIG. 2C is a schematic view illustrating a state where the pressing roller smoothes the wrinkles of or in the medium, and FIG. 2D is a schematic view illustrating a state where the pressing roller smoothes the wrinkles of the medium further from the state of FIG. 2C.

FIG. 3A is a schematic view illustrating a state before a distance sensor faces the medium, FIG. 3B is a schematic view illustrating a state where the distance sensor faces the medium, FIG. 3C is a schematic view illustrating a state after a height of a liquid ejecting unit is adjusted from the state illustrated in FIG. 3B, FIG. 3D is a schematic view illustrating a state where a fan smoothes wrinkles of or in the medium, and FIG. 3E is a schematic view illustrating a state where the fan smoothes the wrinkles of or in the medium further from the state illustrated in FIG. 3D.

FIG. 7A is a schematic view illustrating a state where the medium is mounted on the mounting surface of the base stand, FIG. 7B is a schematic view illustrating a state where a vacuum pump is driven from the state illustrated in FIG. 7A, and FIG. 7C is a schematic view illustrating a state where the vacuum pump is driven further from the state illustrated in FIG. 7B.

DESCRIPTION OF EXEMPLARY EMBODIMENTS

Hereinafter, an embodiment in which a recording apparatus is embodied in an ink jet type printer will be described with reference to the drawings.

Figure 1:
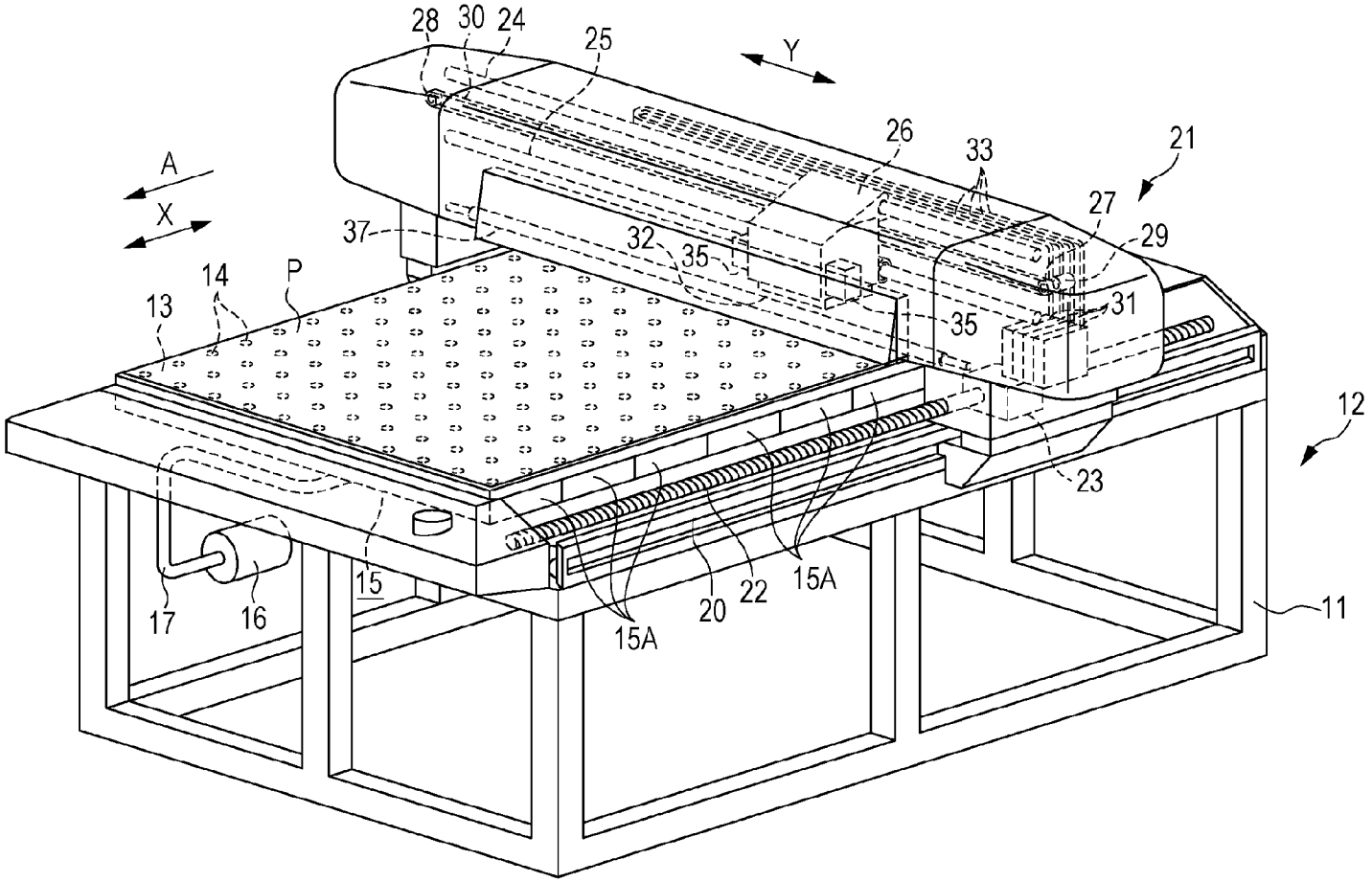
FIG. 1 is a perspective view of an embodiment of a printer.

As illustrated in FIG. 1, the printer includes a base stand 12. The base stand 12 is an example of a support section (mounting section) that includes a support pedestal 11 having a frame structure placed on a floor. An overlying surface of the base stand 12 is a support surface (mounting surface) 13 on which a medium P is supported. A plurality of suction holes 14 are opened to or formed in the support surface 13. Furthermore, a decompression chamber (negative pressure chamber) 15 is provided in an underlying portion of the support surface 13 of the base stand 12. The decompression chamber 15 is underneath the support surface 13.

Figure 2A:
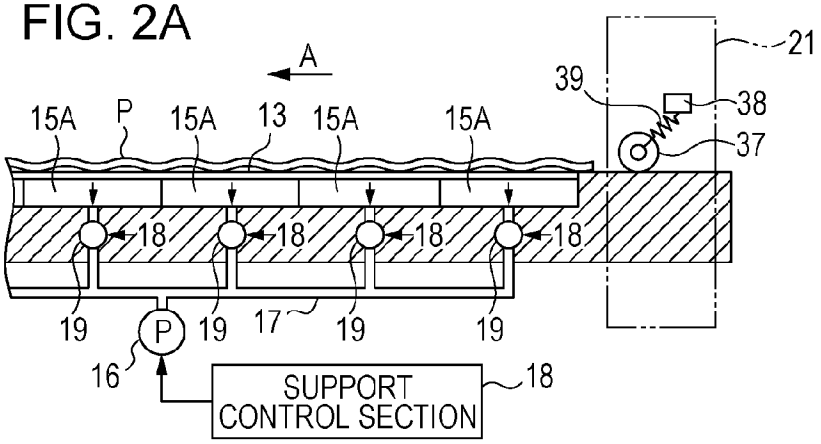
FIGS. 2A to 2D are operational views when a printer of the same embodiment smoothes wrinkles of a medium.

As illustrated in FIG. 2A, the decompression chamber 15 is configured of or includes a plurality of decompression chamber units 15A divided in a longitudinal direction X of the medium P. A plurality of exhaust tubes 17 connected to a vacuum pump 16, which is an example of an absorption section. Devices that suction or generate a negative pressure, or that generate a charge are examples of absorption sections.

The plurality of exhaust tubes 17 are branched so as to individually connect to each of the decompression chamber units 15A. There as many branches in the exhaust tubes 17 as decompression chamber units 15A in one example. Then, if the vacuum pump 16 is driven based on a control command from a support control section 18 that collectively controls an operation of the base stand 12, each of the decompression chamber units 15A is in a decompressed atmosphere. In other words, the decompression chamber units 15A are decompressed and have a lower pressure. As a result, a suction force acts on the medium P supported on the support surface 13 of the base stand 12 through the suction holes 14.

Furthermore, a flow control valve 19 is individually provided for each decompression chamber unit 15A. The flow control valve 19 is provided in a portion further on the decompression chamber unit 15A side than a branch point in the exhaust tube 17. In other words, the flow control valve 19 is located between a branch point in the exhaust tube 17 and the decompression chamber unit 15A. Each flow control valve 19 adjusts a flow rate of air that is exhausted by the vacuum pump 16 from the decompression chamber unit 15A through the exhaust tube 17 by controlling an opening degree based on a control signal from the support control section 18. In one example, the opening degree of each flow control valve 19 is individually adjusted based on the control signal from the support control section 18. Thus, the suction force acting on the medium P supported on the support surface 13 of the base stand 12 can be individually adjusted for each suction hole 14 corresponding to each decompression chamber unit 15A. Moreover, in one embodiment, the support control section 18 can adjust the opening degree of each flow control valve 19 in two stages between "small" and "large". Then, if the opening degree of each flow control valve 19 is "small", the support control section 18 makes the suction force act on the medium P supported on the support surface of the base stand 12 in a first absorption or suction mode. Meanwhile, if the opening degree of each flow control valve 19 is "large", the support control section 18 makes the suction force in a second absorption or suction mode greater than the suction force in the first absorption mode and the support control section 18 causes the suction force in the second absorption mode to act on the medium P supported on the support surface 13 of the base stand 12.

As illustrated in FIG. 1, guide grooves 20 (only one side is illustrated in FIG. 1) are formed on both sides along the longitudinal direction X of the medium P in the base stand 12. Underlying end portions of a gate-shaped liquid ejecting unit 21 extending in a width direction Y intersecting the longitudinal direction X of the medium P are reciprocally fitted into the guide grooves 20 along the longitudinal direction X of the medium P.

Furthermore, a ball screw 22 is bridged in the base stand 12 along a side surface of one side (e.g., the right side in FIG. 1) along the longitudinal direction X of the medium P. The ball screw 22 is connected to a driving mechanism 23 provided in an underlying end portion of one side in a longitudinal direction in the liquid ejecting unit 21. The driving mechanism 23 is configured with a nut member that is screwed to the ball screw 22. A driving motor that drives the nut member to rotate in both forward and reverse directions is provided. Then, if the driving motor of the driving mechanism 23 is driven, the nut member of the driving mechanism 23 moves along the ball screw 22 while rotating. In response, the liquid ejecting unit 21 reciprocates in the longitudinal direction X of the medium P while being guided by the guide grooves 20. Moreover, the base stand 12 is provided with a linear scale (not illustrated) along the longitudinal direction X of the medium P. Thus, an encoder (not illustrated) mounted on the liquid ejecting unit 21 outputs a signal of the number of pulses proportional to a moving distance of the liquid ejecting unit 21 to the support control section 18 through the linear scale. The encoder cooperates with the linear scale to signal a moving distance of the liquid ejecting unit 21.

The liquid ejecting unit 21 includes a main shaft 24 and a sub-shaft 25 along the longitudinal direction thereof. A carriage 26 is slidably supported to the shafts 24 and 25 along the longitudinal direction thereof (the Y direction). A driving pulley 27 and a driven pulley 28 are rotatably supported at positions corresponding to both end portions of both shafts 24 and 25 in the liquid ejecting unit 21. The driving pulley 27 is connected to an output shaft of a carriage motor 29 that is a driving source when reciprocating the carriage 26. An endless timing belt 30 of which a part is connected to the carriage 26 is suspended between a pair of pulleys 27 and 28. Thus, the carriage 26 moves along the longitudinal direction of both shafts 24 and 25 through the endless timing belt 30 by a driving force of the carriage motor 29 while being guided by both shafts 24 and 25.

Ink cartridges 31 that store UV curable ink (hereinafter, referred to as "UV ink") are disposed in one end side (right end side in FIG. 1) in the longitudinal direction of the liquid ejecting unit 21. The UV ink inside the ink cartridges 31 can be supplied to a recording head 32 as an example of a recording section that is supported on an underlying surface of the carriage 26 through an ink supply tube 33. Then, the recording head 32 performs printing on the medium P supported on the support surface 13 of the base stand 12 by ejecting the UV ink supplied from the ink cartridges 31.

Furthermore, when the printing is completed through an entire region of the medium P in the width direction Y, the liquid ejecting unit 21 is moved to one side (left side in FIG. 1) in the longitudinal direction X of the medium P by a fixed amount and then the printing is performed on a part of the medium in the longitudinal direction X of the medium P. In one example, the printing is performed on a part of the medium that is adjacent to a part of the medium that was previously printed.

Furthermore, a pair of irradiators 35 are supported on both side surfaces of the carriage 26. The irradiators 35 are supported on both sides of the recording head 32 in the moving direction of the carriage 26. Then, each irradiator 35 cures the UV ink by irradiating the UV ink ejected onto the medium P with UV light.

Furthermore, as illustrated in FIGS. 1 and 2A to 2D, the liquid ejecting unit 21 includes a pressing roller 37 provided in a hanging manner in a position that is on or located on a front side in a moving direction A of the liquid ejecting unit 21 with respect to the carriage 26 when printing is performed on the medium P. The pressing roller 37 extends through an entire region of the medium P in the width direction Y. A coil spring 39 is disposed between the pressing roller 37 and a load sensor 38. A first end of the coil spring 39 is connected to the load sensor 38 and a second end of the coil spring 39 is connected to both end portions of the pressing roller 37 in the longitudinal direction thereof in one example. The coil spring 39 urges the pressing roller 37 forward obliquely downward in the moving direction A of the liquid ejecting unit 21. Thus, the pressing roller 37 functions as a pressure applying section that applies a pressing force to the medium P supported on the support surface 13 of the base stand 12 based on an urging force from the coil spring 39. In one example, the pressing roller 37 presses a portion of the medium that has not been printed.

Next, a description is given below by focusing on an operation of the printer of one embodiment. More particularly, an operation when the pressing roller 37 smoothes wrinkles generated in the medium P supported on the support surface 13 of the base stand 12 is described.

First, as illustrated in FIG. 2A, the opening degrees of all flow control valves 19 are "small" or set to small. AS a result, the support control section 18 makes the suction force in a first absorption mode act on the entire region of the medium P supported on the support surface 13 of the base stand 12.

Figure 2B:
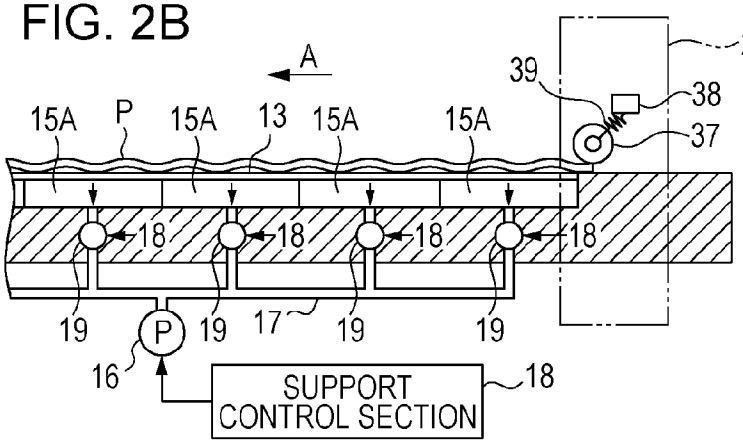

Then, next, as illustrated in FIG. 2B, the liquid ejecting unit 21 is moved forward in the moving direction A by driving the driving mechanism 23. Then, when the pressing roller 37 rides an end of the medium P or rolls over the end of the medium P, the coil spring 39 is elastically compressed. As a result, a load is applied by the coil spring 39 to the load sensor 38 in response to the compression of the coil spring 39. Then, the liquid ejecting unit 21 detects a position of the medium P supported on the support surface 13 of the base stand 12 when a load is applied to the load sensor 38. Furthermore, the liquid ejecting unit 21 sets a start position of the printing operation with respect to the medium P based on a position in which the medium P is detected.

Figure 2C:
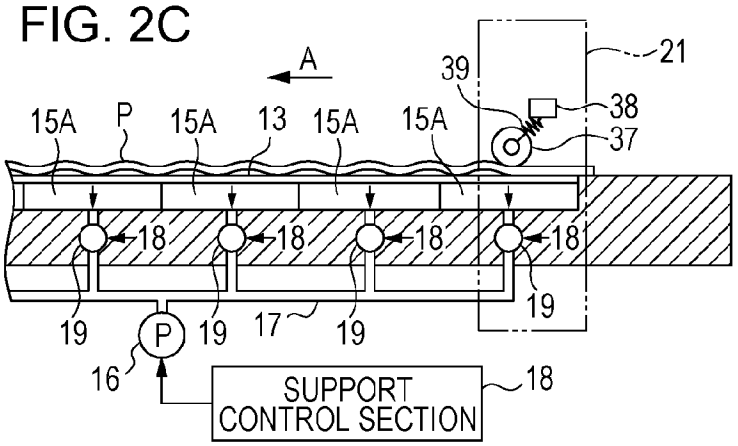

Subsequently, as illustrated in FIG. 2C, the liquid ejecting unit 21 is moved further forward in the moving direction A by driving the driving mechanism 23. Then, the pressing roller 37 presses a portion of the medium P to the support surface 13 of the base stand 12. The printing operation on the medium P is started by the recording head 32 while moving relative to the medium P. At this time, a relatively small suction force acts on the medium P supported on the support surface 13 of the base stand 12. Thus, because the medium P is temporarily fixed to the support surface 13 of the base stand 12 but the medium P is movable, the wrinkles of the medium P are removed when the pressing roller 37 presses the medium P.

Figure 2D:
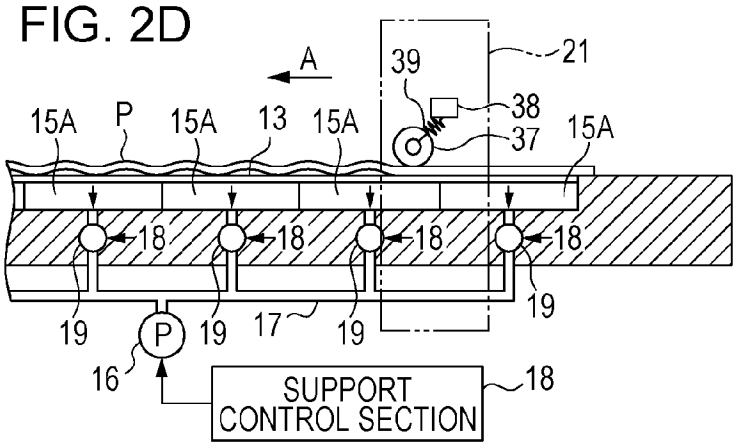

Furthermore, as illustrated in FIG. 2D, the pressing roller 37 passes through a position of the decompression chamber unit 15A on the frontmost side in the moving direction A of the liquid ejecting unit 21. At this time, the support control section 18 changes the opening degree of the flow control valve 19 corresponding to the decompression chamber unit 15A through which the pressing roller 37 passes to be "large" while maintaining the opening degree of the flow control valve 19 corresponding to the decompression chamber unit 15A through which the pressing roller 37 does not pass or has not passed to be "small". Thus, the flow control valves 19 of the decompression chamber units 15A can be different. Then, the suction force in the first absorption mode acts on a portion of the medium in the medium P to which a pressing force is not applied by the pressing roller 37, and the suction force in the second absorption mode acts on a portion of the medium in the medium P to which the press force is or has been applied by the pressing roller 37. As a result, a relatively large suction force acts on a portion of the medium in the medium P in which the wrinkles are or have been removed by pressing from the pressing roller 37.

Next, the operation of the printer of one embodiment will be described.

Meanwhile, in one embodiment, in a state where the medium P is absorbed or suctioned to the support surface 13 of the base stand 12 with a relatively weak suction force, the pressing roller 37 is pressed onto the medium P. Thus, generation of positional deviation of the medium P with respect to the support surface 13 of the base stand 12 is suppressed by pressing from the pressing roller 37 and thereby the wrinkles of the medium P are appropriately removed. In other words, deviations of the position of the medium P with respect to the support surface 13 are suppressed by the pressing roller 37 and/or the relatively weaker suction force and wrinkles can be removed, in one embodiment, as the pressing roller 37 moves forward.

Furthermore, a portion of the medium in the medium P in which the wrinkles have been removed by pressing of the pressing roller 37 is firmly absorbed to the support surface 13 of the base stand 12 by a relatively strong suction force. Thus, the generation of wrinkles again on the support surface 13 of the base stand 12 due to a positional deviation of the medium P after the wrinkles of the medium P have already been removed once is suppressed. In other words, the portion of the medium P that has already been pressed by the pressing roller 37 is suctioned with a relatively stronger force. As a result, the formation of wrinkles is suppressed and a positional deviation of the portion of the medium P that has already been pressed with respect to the support surface is suppressed.

According to the embodiment described above, the following effects can be obtained.

(1) The medium P is absorbed or suctioned to the support surface 13 of the base stand 12. Thereby application of the pressure to the medium P is performed while suppressing a relative movement of the medium P with respect to the support surface 13 of the base stand 12. Thus, it is possible to appropriately remove the wrinkles generated or formed in the medium P.

(2) The application of pressure to the medium P is performed while absorbing or suctioning the medium P to the support surface 13 of the base stand 12 in the first absorption mode, which has a relatively small absorption force. Thus, it is possible to appropriately further remove the wrinkles that are generated in the medium P without stronger-than-necessary absorption or suction of the medium P to the support surface 13 of the base stand 12.

(3) The medium P is strongly absorbed or suctioned to the support surface 13 of the base stand 12 in order from a portion of the medium in which the application of the pressure is completed to the medium P. Thus, it is possible to suppress the generation of wrinkles in the medium P again after the application of pressure to the medium P is completed. In one example, as the pressing roller moves across the medium in the forward direction, the relatively smaller absorption or suction force is applied to the portion of the medium P that has not been pressed while a relatively larger absorption or suction force is applied to the portion of the medium P that has already been pressed. Thus, the portion of the medium P to which the relatively larger suction force is applied becomes larger during the printing operation while the portion of the medium P to which the relatively smaller suction force is applied becomes smaller.

(4) The smoothing operation of the wrinkles of the medium P is performed from a portion of the medium as a starting point in the medium P in which the printing operation is started by the recording head 32. Thus, it is possible to suppress occurrence of positional deviation in the recording starting position of the medium P when smoothing the wrinkles of the medium P.

Next, a second embodiment of a printer will be described. The second embodiment is different from the first embodiment in that a fan blows air to the medium and thereby wrinkles of the medium are removed. Thus, in the following description, configurations different from those of the first embodiment are mainly described and the same reference numerals are given to the configurations that are the same as or corresponding to those of the first embodiment and a redundant description will be omitted.

Figure 3B:
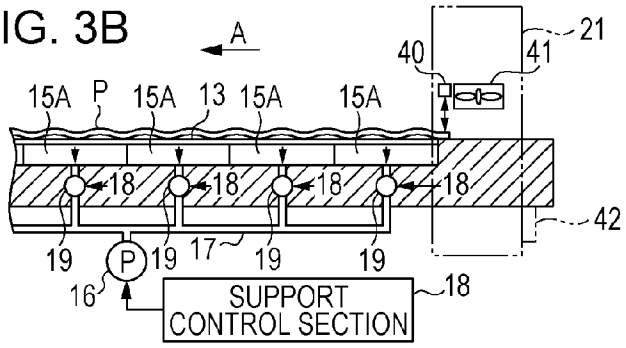
FIGS. 3A to 3E are operational views when a printer of a second embodiment smoothes wrinkles of a medium.
Figure 3D:
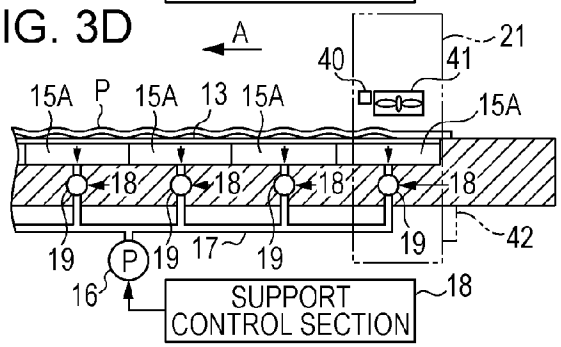
Figure 3A:
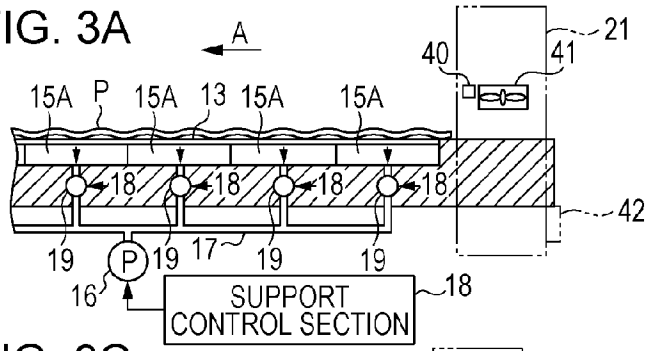

As illustrated in FIG. 3A, a liquid ejecting unit 21 has a distance sensor 40 and a fan 41 in order from the front side of a moving direction A of the liquid ejecting unit 21 when printing a medium P. The distance sensor 40 functions as a sensor for detecting a thickness of the medium P based on a distance from the medium P. Moreover, in one example, the distance sensor 40 may be a non-contact sensor and, for example, it is possible to employ an ultrasonic sensor. Furthermore, the fan 41 functions as a pressure applying section that applies a wind pressure as a pressure to the medium P by blowing air to the medium P supported on a support surface 13 of a base stand 12. Furthermore, the liquid ejecting unit 21 includes a lifting mechanism 42 for vertically lifting and lowering an entirety of the liquid ejecting unit 21. The lifting mechanism 42 functions as a distance adjusting section for adjusting a distance between the medium P and the fan 41 by lifting and lowering the liquid ejecting unit 21.

Next, a description is given below by focusing on an operation of an embodiment of the printer. More particularly, an operation when the fan 41 smoothes wrinkles generated in the medium P supported on the support surface 13 of the base stand 12 is described.

First, as illustrated in FIG. 3A, the opening degrees of all flow control valves 19 are "small". Thus, the support control section 18 makes a suction force in a first absorption mode act on an entire region of the medium P supported on the support surface 13 of the base stand 12.

Then, next, as illustrated in FIG. 3B, the liquid ejecting unit 21 is moved forward in a moving direction A by driving a driving mechanism 23. Then, when a distance detected by the distance sensor 40 is changed, the liquid ejecting unit 21 determines that the medium P is disposed to face the distance sensor 40 and detects a position of the medium P supported on the support surface 13 of the base stand 12. Furthermore, the liquid ejecting unit 21 sets a start position of the printing operation with respect to the medium P based on a position in which the medium P is detected. The distance sensor 40 thus detects the position of the medium P.

Figure 3C:
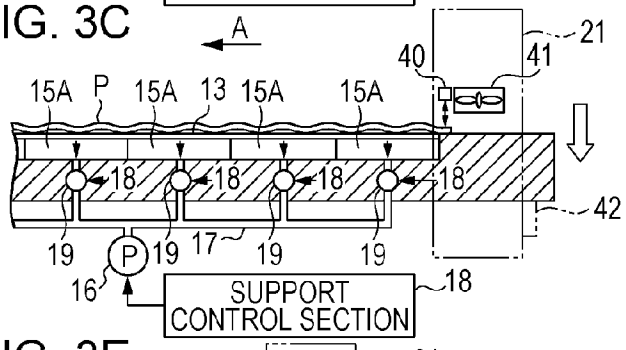

Subsequently, as illustrated in FIG. 3C, the liquid ejecting unit 21 calculates a thickness of the medium P based on a distance between the distance sensor 40 and the medium P. Then, the liquid ejecting unit 21 is moved vertically relative to the base stand 12 by driving the lifting mechanism 42 depending on a thickness of the medium P calculated based on a detection result of the distance sensor 40. Then, the liquid ejecting unit 21 stops the lifting mechanism 42 when the distance between the distance sensor 40 and the medium P reaches a predetermined value. At this time, the distance between the fan 41 and the medium P is also maintained at a predetermined value in a similar manner regardless of the thickness of the medium P.

Subsequently, as illustrated in FIG. 3D, the liquid ejecting unit 21 is moved further forward in the moving direction A by driving the driving mechanism 23. Then, the fan 41 presses a portion of the medium P to the support surface 13 of the base stand 12, on which the printing operation is started by the recording head 32 while moving relative to the medium P. In one example, the fan 41 presses the portion of the medium P facing the fan 41. At this time, a relatively small suction force acts on the medium P supported on the support surface 13 of the base stand 12. Thus, the medium P is temporarily fixed to the support surface 13 of the base stand 12, but the wrinkles of the medium P are removed when the fan 41 blows air.

Figure 3E:
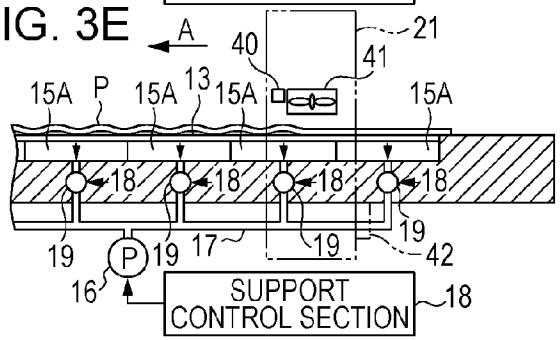

Furthermore, as illustrated in FIG. 3E, the fan 41 passes through or is past a position of the decompression chamber unit 15A on the frontmost side in the moving direction A of the liquid ejecting unit 21. At this time, the support control section 18 changes the opening degree of the flow control valve 19 corresponding to the decompression chamber unit 15A through which the fan 41 passes to be "large" while maintaining the opening degree of the flow control valve 19 corresponding to the decompression chamber unit 15A through which the fan 41 does not pass or has not passed to be "small". Then, the suction force in the first absorption mode acts on a portion of the medium in the medium P to which a wind force is not applied from the fan 41, and a suction force in the second absorption mode acts on a portion of the medium in the medium P in which the application of the wind pressure is performed by the fan 41. As a result, a relatively large suction force acts on a portion of the medium in the medium P in which the wrinkles are or have been removed by applying the wind pressure from the fan 41. In one example, the relatively large suction force is applied after the fan 41 passes the corresponding decompression chamber unit 15A.

According to the second embodiment described above, the following effects can be obtained in addition to the effects of effects (1) to (4) of the first embodiment described above.

(5) Even if the thickness of the medium P supported on the support surface 13 of the base stand 12 changes, the distance between the medium P and the fan 41 is maintained at an appropriate length. Thus, it is possible to appropriately remove the wrinkles generated in the medium P by blowing the air from the fan 41.

In addition, each embodiment described above may be changed in the following forms.

- In the first embodiment described above, the pressing roller 37 may perform the smoothing operation of smoothing the wrinkles of the medium P by pressing the medium P to the support surface 13 while the liquid ejecting unit 21 is moved in the direction opposite to the moving direction A. In this case, the smoothing operation of the wrinkles of the medium P is performed from a portion of the medium, which is a starting point, in the medium P on the side in the longitudinal direction X opposite to the portion of the medium in the medium P in which the printing operation is started by the recording head 32.
- In the second embodiment described above, the fan 41 may perform the smoothing operation of the wrinkles of the medium P by pressing the medium P to the support surface 13 by blowing the air to the medium P while the liquid ejecting unit 21 is moved in the opposite direction to the moving direction A. In this case, the smoothing operation of the wrinkles of the medium P is performed from a portion of the medium, which is a starting point, in the medium P on the side in the longitudinal direction X opposite to the portion of the medium in the medium P in which the printing operation is started by the recording head 32.
- In the second embodiment described above, the liquid ejecting unit 21 may be configured to include a lifting mechanism for adjusting the height of the fan 41. In this case, the liquid ejecting unit 21 may vertically move the fan 41 relative to the medium P by driving the lifting mechanism depending on the thickness of the medium P calculated based on the distance between the distance sensor 40 and the medium P.
- In the second embodiment described above, the liquid ejecting unit 21 may vary a size of a wind force blowing from the fan 41 to the medium P depending on the thickness of the medium P calculated based on the distance between the distance sensor 40 and the medium P. The calculation of the thickness may also be determined using the distance to the support surface of the medium in combination with the distance to the medium P.
- In each embodiment described above, the support control section 18 causes the suction force to act on the entire region of the medium P in the first absorption mode while operating the smoothing operation of the wrinkles of the medium P. On the other hand, after the smoothing operation of the wrinkles of the medium P is completed on the entire region of the medium P, the absorption force in the second absorption mode may act on the entire region of the medium P at once.
- In each embodiment described above, the support control section 18 may constantly maintain the suction force acting on the medium P before and after the smoothing operation of smoothing the wrinkles of the medium P is performed.
- In each embodiment described above, the base stand 12 is provided with a suction fan in the underlying portion of the support surface 13 and the medium P may be absorbed to or suctioned to the support surface 13 by driving the suction fan. Furthermore, the base stand 12 may electrostatically absorb or attract the medium P to the support surface 13 by charging the support surface 13.

Hereinafter, a third embodiment in which a recording apparatus is embodied in an ink jet type printer will be described with reference to the drawings.

Figure 4:
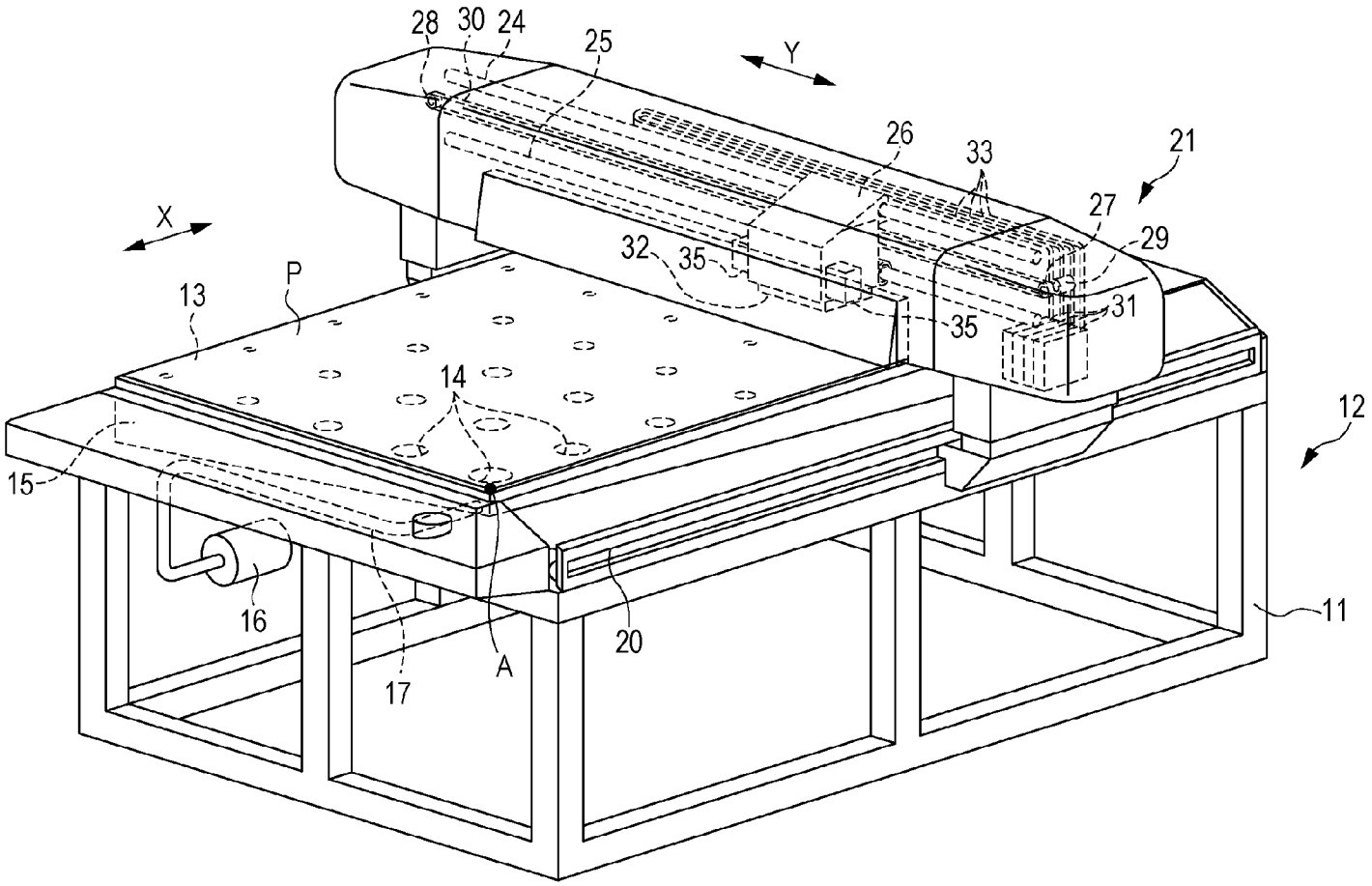
FIG. 4 is a perspective view of an embodiment of a printer.

As illustrated in FIG. 4, the printer includes a base stand 12 as an example of a mounting section. The base stand 12 is configured to include a support pedestal 11 having a frame structure placed on a floor in one example. An overlying surface of the base stand 12 is a rectangular mounting surface 13 on which a medium P is mounted. A plurality of suction holes 14 are opened to or formed in the mounting surface 13. Furthermore, a negative pressure chamber 15 communicating with the suction hole 14 is provided in an underlying portion of the support surface 13 of the base stand 12. A vacuum pump 16 is an example of an absorption or suction section and is connected to the negative pressure chamber 15 through an exhaust tube 17. Then, if the vacuum pump 16 is driven, the negative pressure chamber 15 is placed in a decompressed atmosphere and thereby a suction force acts on the medium P mounted on the mounting surface 13 of the base stand 12 through the suction holes 14.

Figure 5:
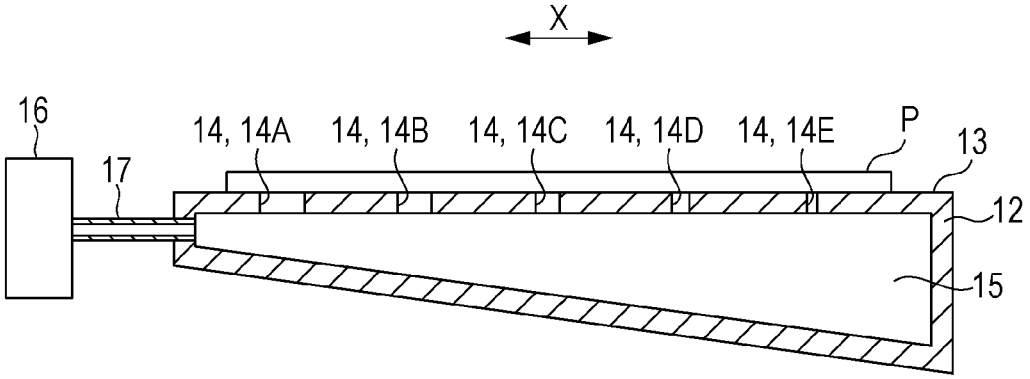
FIG. 5 is a transverse cross-sectional view schematically illustrating an embodiment of a base stand of the printer.

Moreover, as illustrated in FIGS. 4 and 5, a bottom surface of the negative pressure chamber 15 is a tilted surface having a downward gradient from a corner portion A (FIG. 4) that is a respective end portion of both a longitudinal direction X (first direction) and a lateral direction Y (second direction) of the mounting surface 13 of the base stand 12 as a distance of the mounting surface 13 from the corner portion A is increased in the longitudinal direction X. Thus, an opening area of a cross section of the negative pressure chamber 15 orthogonal to the longitudinal direction X is gradually widened as the distance of the mounting surface 13 from the corner portion A of the mounting surface 13 of the base stand 12 is increased in the longitudinal direction X.

Furthermore, as illustrated in FIG. 4, the bottom surface of the negative pressure chamber 15 is the tilted surface and has the downward gradient from the corner portion A of the mounting surface 13 of the base stand 12 as a distance of the mounting surface 13 from the corner portion A is increased in the lateral direction Y.

Thus, the opening area of the cross section of the negative pressure chamber 15 orthogonal to the lateral direction Y is gradually widened as the distance of the mounting surface 13 from the corner portion A of the mounting surface 13 of the base stand 12 is increased in the lateral direction Y.

Thus, the downward gradient of the bottom surface of the negative pressure chamber 15 is present in both the X direction and the Y direction.

Guide grooves 20 (only one side is illustrated in FIG. 4) are formed on both sides of the base stand 12 along the longitudinal direction X of the mounting surface 13. Underlying end portions of a gate-shaped liquid ejecting unit 21 that is long in one direction are reciprocally fitted into the guide grooves 20 along the longitudinal direction X of the mounting surface 13. Thus, the liquid ejecting unit 21 reciprocates in the longitudinal direction X of the mounting surface 13 while being guided by the guide grooves 20.

The liquid ejecting unit 21 has a main shaft 24 and a sub-shaft 25 along the longitudinal direction thereof. A carriage 26 is slidably supported on the shafts 24 and 25 along the longitudinal direction thereof.

A driving pulley 27 and a driven pulley 28 are rotatably supported at positions corresponding to both end portions of both shafts 24 and 25 in the liquid ejecting unit 21. The driving pulley 27 is connected to an output shaft of a carriage motor 29 that is a driving source when reciprocating the carriage 26 and an endless timing belt 30 of which a part is connected to the carriage 26 is suspended between a pair of pulleys 27 and 28. Thus, the carriage 26 moves along the longitudinal direction of both shafts 24 and 25 through the endless timing belt 30 by a driving force of the carriage motor 29 while being guided by both shafts 24 and 25.

Ink cartridges 31 that store UV curable ink (hereinafter, referred to as "UV ink") are disposed in one end side (right end side in FIG. 4) in the longitudinal direction of the liquid ejecting unit 21. The UV ink inside the ink cartridges 31 can be supplied to a recording head 32 as an example of a recording section that is supported on an underlying surface of the carriage 26 through an ink supply tube 33. Then, the recording head 32 performs printing on the medium P mounted on the mounting surface 13 of the base stand 12 by ejecting the UV ink supplied from the ink cartridges 31.

Furthermore, a pair of irradiators 35 are supported on both side surfaces of the carriage 26. The irradiators 35 are supported on both sides of the recording head 32 in the moving direction of the carriage 26. Then, each irradiator 35 cures the UV ink by irradiating the UV ink ejected onto the medium P with UV light.

Figure 6:
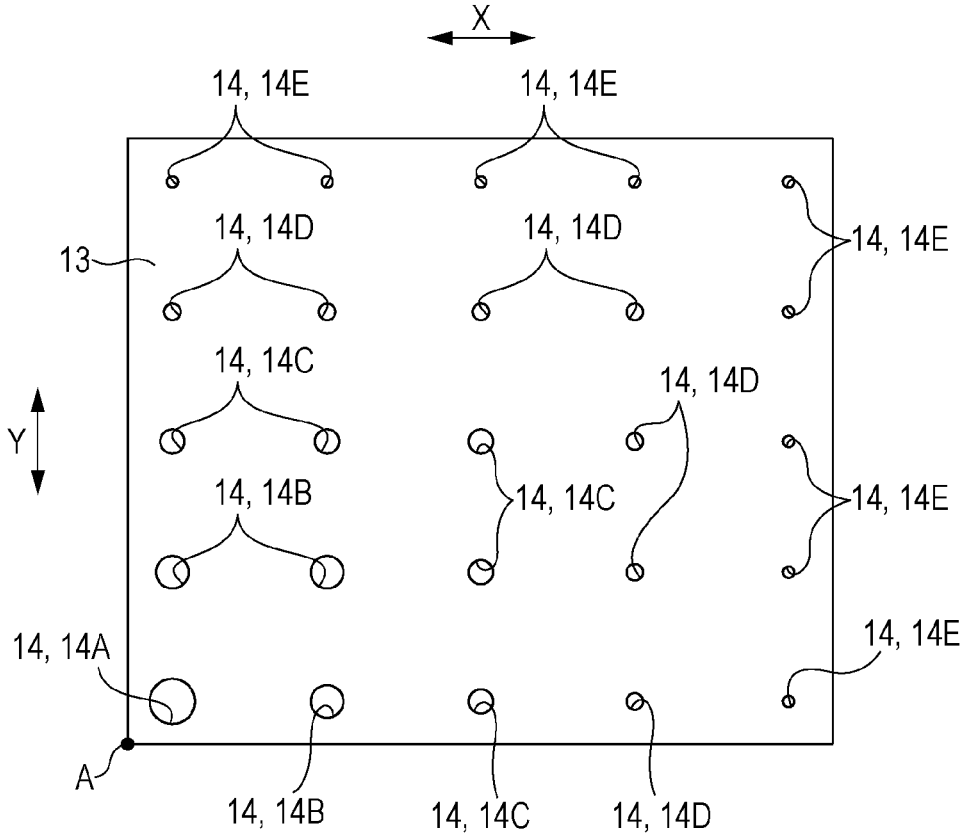
FIG. 6 is a schematic view illustrating an arrangement of suction holes in an embodiment of the printer.

Moreover, as illustrated in FIGS. 4 and 6, in one embodiment, the suction holes 14 are disposed on the mounting surface 13 of the base stand 12 in a grid pattern and the opening area of the suction holes 14 adjacent to each other is great in the suction hole 14 of which the distance is relatively short from one corner portion A of the mounting surface 13. That is, the opening area of the suction hole 14 is gradually narrowed as the distance from the corner portion A of the mounting surface 13 of the base stand 12 is increased. Stated differently, some of the suction holes closer the corner portion A may have a wider opening than some of the suction holes further away from the corner portion A in one example.

Moreover, in one embodiment, the suction holes 14 are referred to as a first suction hole 14A, a second suction hole 14B, a third suction hole 14C, a fourth suction hole 14D, and a fifth suction hole 14E in order from the opening area being wide. Thus, the suction hole 14A is the widest and the suction hole 14E is the narrowest. In this case, the corner portion A corresponds to a portion of the medium in the medium P mounted on the mounting surface 13 of the base stand 12, in which the printing is started and is a reference position when performing the printing on the medium P. Then, the liquid ejecting unit 21 starts the printing from a portion of the medium in the medium P which is mounted on the corner portion A of the mounting surface 13 of the base stand 12. Furthermore, the exhaust tube 17 is connected to a portion corresponding to the corner portion A of the mounting surface 13 in the negative pressure chamber 15.

Next, an operation of the printer of the embodiment will be described below particularly focusing on an operation of the printer when the medium P is absorbed or suctioned to the mounting surface 13 of the base stand 12.

Figure 7A:
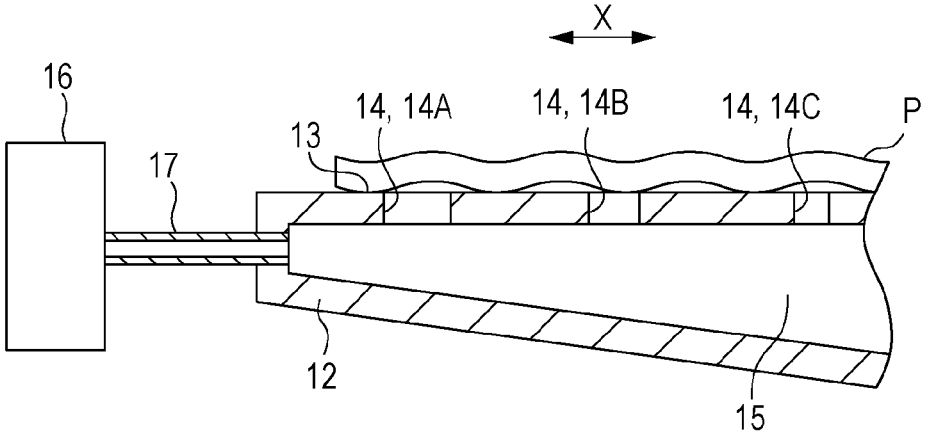
FIGS. 7A to 7C are operational views when the printer of the same embodiment absorbs the medium to a mounting surface of the base stand.

First, as illustrated in FIG. 7A, in a state where the driving of the vacuum pump 16 is stopped, the medium P is mounted on the mounting surface 13 of the base stand 12. In this case, openings of the suction holes 14A to 14E formed on the mounting surface 13 of the base stand 12 are covered by the medium P from above.

Figure 7B:
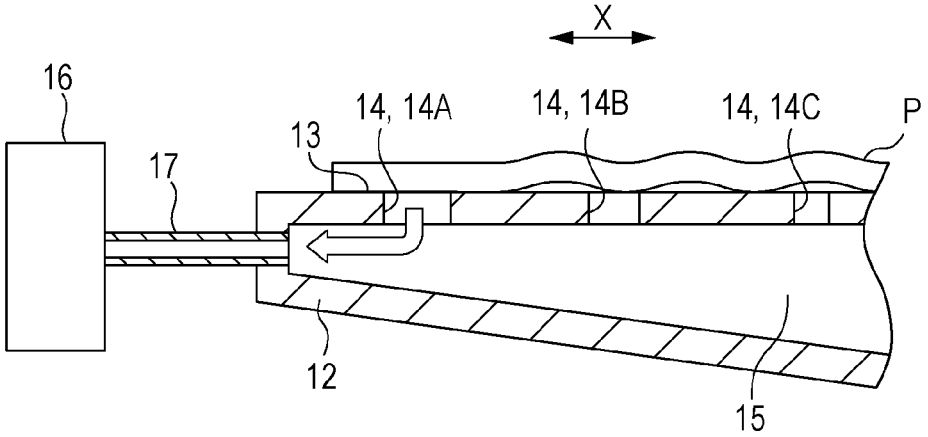

Next, as illustrated in FIG. 7B, when the driving of the vacuum pump 16 is started, the air inside the negative pressure chamber 15 is exhausted through the exhaust tube 17. At this time, the exhaust tube 17 exhausts the air from a position corresponding to the corner portion A of the mounting surface 13 in the negative pressure chamber 15. Thus, the air is sucked and a negative pressure is generated from or in the first suction hole 14A of which the distance is shortest from the corner portion A of the mounting surface 13 of a plurality of suction holes 14A to 14E formed on the mounting surface 13 of the base stand 12. In other words, the suction hole 14A may be closes to the corner portion A and closest to the exhaust tube 17.

Then, a portion of the medium in the medium P which is mounted on the corner portion A of the mounting surface 13 is absorbed or suctioned on the mounting surface 13 and thereby wrinkles generated in the same portion of the medium is removed.

Figure 7C:
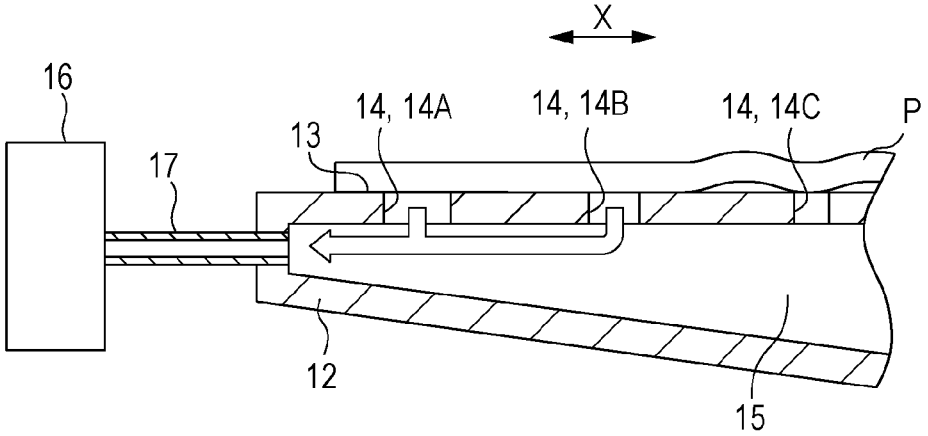

Subsequently, as illustrated in FIG. 7C, when the driving of the vacuum pump 16 is continued, the air is sucked and a negative pressure is generated from or in the second suction hole 14B of which the distance from the corner portion A of the mounting surface 13 is secondarily close in the plurality of suction holes 14A to 14E formed on the mounting surface 13 of the base stand 12. In other words, the suction hole 14B is the next closest suction hole. That is, the negative pressure is generated inside the second suction hole 14B, which is adjacent to the first suction hole 14A and in which the negative pressure is initially generated in the plurality of suction holes 14A to 14E formed on the mounting surface 13 of the base stand 12. Thus, a portion of the medium in the medium P which is adjacent to the portion of the medium already absorbed or suctioned to the mounting surface 13 is absorbed or suctioned to the mounting surface 13. Consequently, wrinkles generated in the same portion of the medium are removed.

Thereafter, if the driving of the vacuum pump 16 is continued, the air is sucked and a negative pressure is generated in order of the third suction hole 14C, the fourth suction hole 14D, and the fifth suction hole 14E. That is, the air is sucked and the negative pressure is generated in order from the suction hole of which the distance is close to the corner portion A of the mounting surface 13 of the suction holes 14A to 14E opened to the mounting surface 13 of the base stand 12. As a result, a portion which is adjacent to the portion of the medium in the medium P that is already absorbed or suctioned to the mounting surface 13 is absorbed to the mounting surface 13 in order and thereby the wrinkles generated in the entirety of the medium P are removed.

Stated differently, the pressure chamber 15 is shaped and the suction holes are shaped and arranged such that different portions of the medium P are suctioned at different times. This allows the medium P to be smoothed gradually from the corner point A in the X and Y directions.

According to the third embodiment described above, it is possible to obtain the following effects.

(1) The absorption operation is performed to the medium P mounted on the mounting surface 13 of the base stand 12 in order from one end side to the other end side of the medium P. Thus, it is possible to suppress occurrence of the wrinkles in the medium P when the medium P is absorbed or suctioned to the mounting surface 13 of the base stand 12.

(2) The absorption or suction operation is performed to the medium P mounted on the mounting surface 13 of the base stand 12 in order from the portion of the medium in which the printing is started. Thus, it is possible to suppress occurrence of the positional deviation of a printing starting position of the medium P when the medium P is absorbed or suctioned to the mounting surface 13 of the base stand 12. In other words, the portion of the medium P on which printing begins is suctioned such that movement of the medium P to the mounting surface 13 is suppressed.

(3) In the suction holes 14A to 14E, the negative pressure is generated in order from the first suction hole 14A provided in the corner portion A of the mounting surface 13. Thus, it is possible to realize a configuration in which the absorption operation is performed to the medium P mounted on the mounting surface 13 of the base stand 12 in order from one end side to the other end side of the medium P.

(4) In the negative pressure chamber 15, a cross-sectional area of the flow path of the air that is sucked by the vacuum pump 16 is gradually widened as the distance from the corner portion A of the mounting surface 13 is increased. Thus, a time difference is likely to occur with respect to when the negative pressure is generated in the suction holes 14A to 14E formed in the mounting surface 13 of the base stand 12 leaving from the corner portion A of the mounting surface 13. Thus, a time for adjusting a shape of the medium P is secured from when the portion of the medium in the medium P which is mounted on the corner portion A of the mounting surface 13 is absorbed or suctioned to when an adjacent portion of the medium is absorbed or suctioned. Thus, when the medium P is absorbed to the mounting surface 13 of the base stand 12, it is possible to further suppress the occurrence of wrinkles in the medium P.

(5) The opening area of the suction holes 14A to 14E is gradually narrowed as the distance from the corner portion A of the mounting surface 13 is increased. Thus, in a state where the portion of the medium in the medium P which is mounted on the corner portion A of the mounting surface 13 is firmly absorbed or suctioned, the absorption or suction operation is performed in order from one end side to the other end side of the medium P from the portion of the medium as a starting point. Thus, it is possible to suppress the occurrence of wrinkles in the medium P when the medium P is absorbed or suctioned to the mounting surface 13 of the base stand 12.

Moreover, the embodiments described above can be performed in the following forms.

Figure 8A:
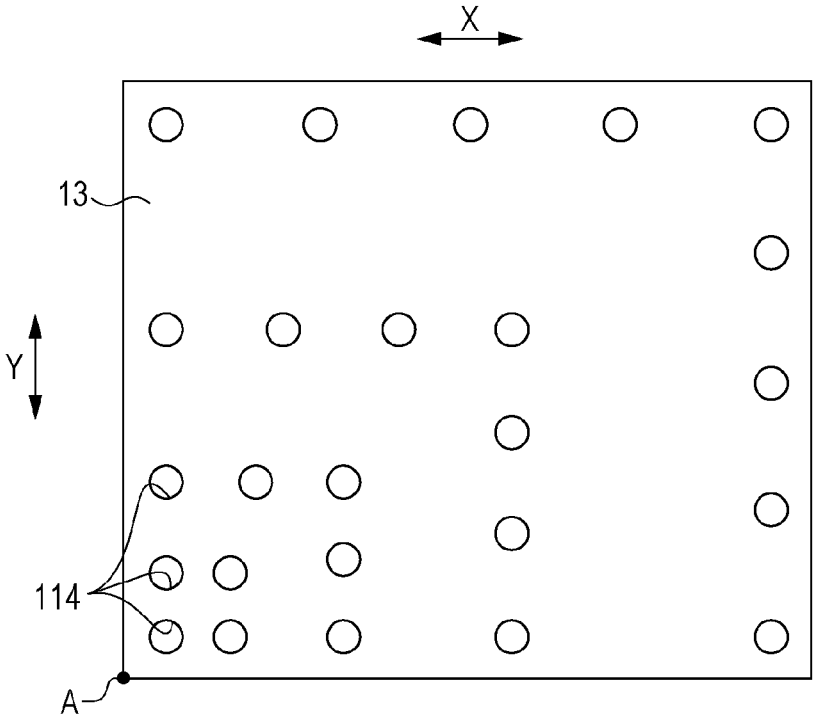
FIGS. 8A and 8B are schematic views illustrating an arrangement of suction holes in other embodiments of printers.

In the embodiments described above, as illustrated in FIG. 8A, a hole density of suction holes 114 may be gradually decreased as the distance of the suction hole 114 from the corner portion A of the mounting surface 13 is increased. In this case, the opening areas of all of the suction holes 114 may be equal to each other. Alternatively, the opening areas of the suction holes 114 may be gradually narrowed as the distance from the corner portion A of the mounting surface 13 is increased.

Figure 8B:
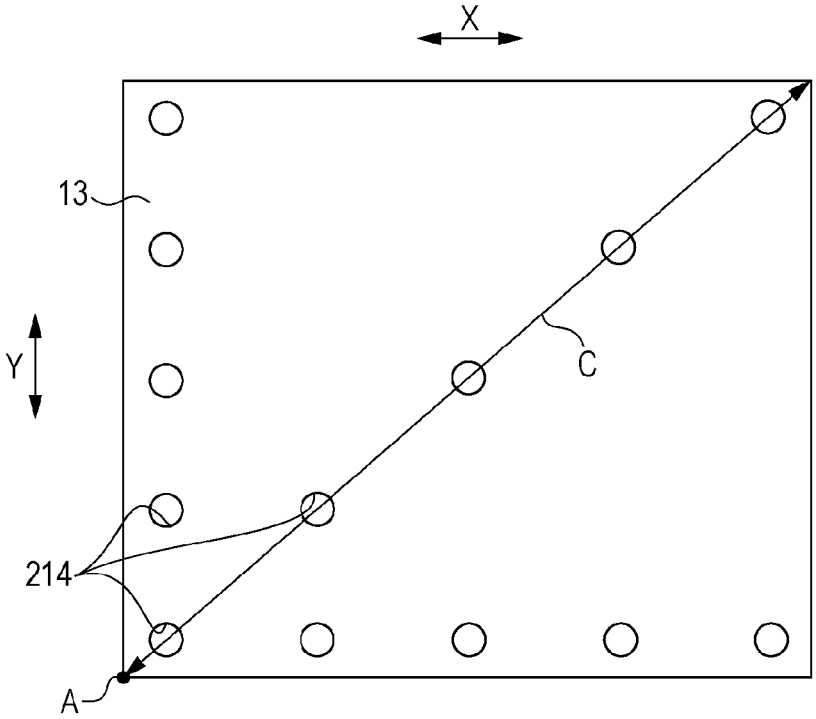

In the embodiments described above, as illustrated in FIG. 8B, suction holes 214 may be arranged radially in the longitudinal direction X, the lateral direction Y, and a diagonal direction C of the mounting surface 13 from the corner portion A of the mounting surface 13 of the base stand 12 as a starting point. In this case, the suction holes 214 may be arranged with equal intervals in each of the directions X, Y, and C. Alternatively, intervals between the suction holes 214 in each of the directions X, Y, and C may be arranged so as to be gradually widened as the distance from the corner portion A of the mounting surface 13 is increased. Furthermore, in this case, the opening areas of the entire suction holes 214 may be equal to each other or the opening areas of the suction holes 214 may be gradually narrowed as the distance from the corner portion A of the mounting surface 13 is increased.

In the embodiments described above, the negative pressure chamber 15 may be configured such that the opening area of the cross section orthogonal to the longitudinal direction X over the entire region in the longitudinal direction X of the mounting surface 13 is constant. Furthermore, the negative pressure chamber 15 may be configured such that the opening area of the cross section orthogonal to the lateral direction Y over the entire region in the lateral direction Y of the mounting surface 13 is constant.

In the embodiments described above, the exhaust tube 17 may be connected to a position of the negative pressure chamber 15 corresponding to the corner portion opposite to the corner portion A of the mounting surface 13 in the longitudinal direction X of the mounting surface 13. In this case, the absorption operation to the mounting surface 13 is performed from a portion of the medium as a starting point that is on the side opposite to the portion of the medium in the medium P in the longitudinal direction X of the mounting surface 13 in which the printing operation is started by the recording head 32.

In the embodiments described above, the exhaust tube 17 may be connected to a position corresponding to a center portion in the lateral direction Y of the mounting surface 13 in the negative pressure chamber 15. In this case, the exhaust tube 17 may be connected to the center portion of a short side of the mounting surface 13 including the corner portion A of the mounting surface 13 in the negative pressure chamber 15 or may be connected to the center portion of the short side of the mounting surface 13 including the corner portion that is in the opposite side to the corner portion A of the mounting surface 13 in the longitudinal direction X of the mounting surface 13 in the negative pressure chamber 15.

In the embodiments described above, the base stand 12 is provided with a plurality of suction fans in the underlying portion of the mounting surface 13 and the medium P may be absorbed to the mounting surface 13 by driving the suction fans. In this case, in the base stand 12, driving is performed in order from a suction fan in the plurality of suction fans of which the distance from the corner portion A of the mounting surface 13 is short, and thereby the absorption or suction operation is performed to the medium P mounted on the mounting surface 13 of the base stand 12 in order from one end side to the other end side of the medium P.

In the embodiments described above, in the base stand 12, the medium P may be electrostatically absorbed or attached to the mounting surface 13 by charging the support surface 13. In this case, charging is performed in order from a portion of a surface in the mounting surface 13 of which the distance from the corner portion A is short and thereby the absorption or attachment operation is performed to the medium P mounted on the mounting surface 13 of the base stand 12 in order from one end side to the other end side of the medium P.

In the embodiments described above, the printer as the recording apparatus may be a fluid ejecting apparatus that performs recording by ejecting or discharging a fluid (including a liquid, a liquid body that is formed by dispersing or mixing particles of a functional material into a liquid, a fluid body such as a gel, and a solid that can flow to be ejected as a fluid) other than ink. For example, the recording apparatus may be a liquid body ejecting apparatus that performs recording by ejecting a liquid body containing a material of an electrode material, a color material (pixel material), and the like as a dispersed or dissolved form, which is used for manufacturing a liquid crystal display, an electroluminescence (EL) display, a surface emitting display, and the like. Furthermore, the recording apparatus may be a fluid body ejecting apparatus that ejects a fluid body such as a gel (for example, a physical gel) or may be a particulate material ejecting apparatus (for example, a toner jet type printing apparatus) for ejecting a solid such as toner that is an example of powder (particulate material). Then, it is possible to apply the invention to the fluid ejecting apparatus of any one of these types. In this specification, "fluid" is a concept not including a fluid composed of only gas and the fluid includes, for example, a liquid (including an inorganic solvent, an organic solvent, a solution, a liquid resin, a liquid metal (metallic melt), and the like), a liquid body, a fluid body, the particulate material (including granules and powder), and the like.

What is claimed is:

1. A recording apparatus having a recording section that performs recording on a medium, the recording apparatus comprising:

a mounting section that has a mounting surface capable of mounting the medium, the mounting surface including a plurality of suction holes, a decompression chamber located underneath the mounting section, wherein the decompression chamber communicates with the plurality of suction holes, an exhaust tube that is connected to a first corner of the mounting surface in the decompression chamber, wherein the exhaust tube sucks air through the plurality of suction holes, a recording head that performs recording when a state of suction is performed without moving medium, wherein a ratio per unit area of the plurality of suction holes is gradually decreased as a distance from the first corner to other corners.

2. The recording apparatus according to claim 1, wherein when directions orthogonal to each other in a direction along the mounting surface of the mounting section are a first direction and second direction, the end portion includes end portions of both the first direction and the second direction in the mounting surface of the mounting section.

3. The recording apparatus according to claim 1, wherein the recording section starts recording from a portion of the medium in the medium mounted on the end portion of the mounting section.

4. The recording apparatus according to claim 1, wherein the holes of the plurality of suction holes are opened to the mounting surface and negative pressure chambers that communicate with the plurality of suction holes, and wherein a suction section sucks the medium mounted on the mounting surface through the suction holes and suctions the medium to the mounting surface by generating a negative pressure in the negative pressure chambers by sucking air inside the negative pressure chambers beginning from the end portion of the mounting section.

5. The recording apparatus according to claim 4, wherein in the negative pressure chamber, a cross-sectional area of a flow path of air which is sucked by the suction section gradually widens as a distance from the end portion of the mounting section is increased.

6. The recording apparatus according to claim 4, wherein the plurality of suction holes are arranged radially from the end portion with respect to the mounting surface of the mounting section.

7. The recording apparatus according to claim 4, wherein opening areas of the plurality of suction holes are gradually narrowed as the distance from the end portion of the mounting section is increased.

8. The recording apparatus according to claim 1, wherein the decompression chamber comprises a single negative pressure generator.

9. The recording apparatus according to claim 1, further comprising a suction section that includes the decompression chamber, which is a negative pressure chamber, wherein the negative pressure chamber comprises a tilted bottom surface having a downward gradient from an end position.

10. The recording apparatus according to claim 1, wherein changes in the ratio per unit area of the plurality of suction holes depend on number of the plurality of suction holes.

11. The recording apparatus according to claim 1, wherein air is sucked, in order, from a suction hole closest to the exhaust tube to a suction hole farthest from the exhaust tube.

12. The recording apparatus according to claim 1, wherein when the air is sucked, a negative pressure is generated in a first suction hole closest to the exhaust tube before a negative pressure is generated in a second suction hole further away from the exhaust tube than the first suction hole.

* * * * *